United States Patent [19]

Purser

[11] 4,119,398

[45] Oct. 10, 1978

[54] COMPOSITION FOR PRE-TREATING FABRIC FOR TRANSFER PRINTING AND A TRANSFER PRINTING PROCESS

[76] Inventor: Terry Brook Purser, 17 The Lawns, Hatch End, England

[21] Appl. No.: 829,479

[22] Filed: Aug. 31, 1977

[30] Foreign Application Priority Data

Aug. 31, 1976 [GB] United Kingdom ..... 35982/76

[51] Int. Cl.[2] ..... D06P 5/06; D06P 5/08; D06P 5/10

[52] U.S. Cl. ..... 8/2.5 R; 8/178; 260/21; 260/23 AR; 260/29.4 UA

[58] Field of Search ..... 8/2.5 A, 2.5 R, 17, 8/176; 260/21, 23 AR, 29.4 UA

[56] References Cited

U.S. PATENT DOCUMENTS

| | | | |
|---|---|---|---|
| 3,592,686 | 7/1971 | Barber et al. | 260/29.4 UA |
| 3,706,595 | 12/1972 | Drelich et al. | 260/29.4 UA |
| 3,896,070 | 7/1975 | Tummler et al. | 260/29.4 UA |
| 3,935,147 | 1/1976 | Godshalk et al. | 260/29.4 UA |
| 3,995,992 | 12/1976 | Défago et al. | 8/2.5 R |
| 3,997,701 | 12/1976 | Ealding et al. | 260/29.4 UA |
| 4,009,000 | 2/1977 | Buhler | 8/17 |

FOREIGN PATENT DOCUMENTS

| | | | |
|---|---|---|---|
| 693,453 | 9/1964 | Canada | 260/29.4 UA |
| 2,453,362 | 5/1975 | Fed. Rep. of Germany | 8/2.5 R |

*Primary Examiner*—Ronald W. Griffin
*Attorney, Agent, or Firm*—Bertram Frank

[57] ABSTRACT

A composition for the treatment of a fabric containing fibres which do not readily retain dyes imparted thereto by transfer printing, such as wool and cellulosic fibres e.g. cotton, the treatment being prior to transfer printing on the fabric and the composition comprising in combination (a) a coating material comprising a self-curing acrylic resin composition,
(b) at least one of (i) an agent for softening the fibres of the fabric and (ii) a self-curing elastomeric polysiloxane composition, and optionally one or more of the following ingredients:
(c) a curable amine-formaldehyde prepolymer containing free hydroxyl groups,
(d) a polymer emulsion,
(e) at least one humectant,
(f) a wetting agent, and
(g) a dispersion stabiliser for the composition.

The resin content of the coating deposited from the composition on the fabric is preferably substantially completely cured prior to transfer printing.

18 Claims, No Drawings

COMPOSITION FOR PRE-TREATING FABRIC FOR TRANSFER PRINTING AND A TRANSFER PRINTING PROCESS

This invention relates to the printing of fabrics by the method known commercially as heat-transfer printing. In this method, the coloured pattern to be imparted to the fabric, e.g. a textile or knitted material, is initially prepared as a print on a heat-transfer sheet, which is usually of paper. The inks used for preparing the printed pattern are selected to volatilize or sublime at a temperature acceptable to the substrate. The transfer is placed in contact with the fabric and heat is applied and the inks are transferred by heat to the fabric. The fabric has to be of such a nature that it will receive and retain the transferred inks, so as to give a permanent print on the fabric. The mechanism of the transfer step is believed to be that the gases resulting from volatilisation or sublimation of the respective inks are absorbed by at least the outer surface layers of the individual fibres of the fabric. This effect can readily be obtained on fabrics made from synthetic fibres, especially polyester fibres, and very large quantities of woven items printed in this manner have been produced commercially. The method is relatively quick, simple to carry out, cheap in materials and labour, and gives a good permanent print in as many colours as are imparted to the original transfer sheet. Above all, it enables the multi-colour printing operation to be carried out on a conventional printing machine on a sheet of paper, and eliminates costly and cumbersome silk screen operations carried out on the fabric itself.

A disadvantage of this method, however, is that when applied to fabrics containing e.g. wool or cellulosic fibres, e.g. cotton fibres, the ink tends to wash out. With cotton-mixture fabrics the effectiveness is relative to the percentage of synthetic fibre present in the fabric, but is generally unsatisfactory.

It is an object of the present invention to provide improvements whereby transfer printing can be carried out on substrates containing fibres, such as wool or cellulosic fibres, which do not readily retain dyes imparted thereto by transfer printing, to produce articles in which the colour has improved fastness to washing.

According to the present invention there is provided a composition for the treatment of a fabric containing fibres which do not readily retain dyes imparted thereto by transfer printing, and prior to transfer printing on the fabric, the composition comprising in combination (a) a coating material comprising a self-curing acrylic resin composition, and (b) at least one of (i) an agent for softening the fibres of the fabric and (ii) a self-curing elastomeric polysiloxane composition.

The components are most preferably provided in an aqueous medium, e.g. as an emulsion or dispersion therein.

Fabrics treated with this composition and thereafter subjected to conditions to cure the resin component of the composition and which are subjected to transfer printing show valuable improvements in wash fastness of the colour. Moreover, the use of the composition reduces or eliminates any hardening or coarsening which might otherwise arise from application of the self-curing resin material and this in turn permits a somewhat greater amount of resin material to be used and the fastness of the printing to be accordingly increased. A similar effect is obtained where the softener is replaced by the self-curing polysiloxane elastomer composition or used together with it. Thus, the conjoint use of the two components of the composition produces a synergistic effect in that the improvements obtained are not merely those which would be expected from the respective properties of the components.

Where the self-curing polysiloxane elastomer composition is employed, the additional advantage is gained that the fabric treated with the composition has water-repellant properties.

Examples of fibres that do not readily retain dyes imparted thereto by transfer printing are cellulosic fibres (natural or regenerated) and wool.

Examples of self-curing acrylic resin compositions that may be used are "VINACRYL" 43080 available from Vinyl Products Ltd., "NEOCRYL" Q717, N.L. 10D and N.L. 10E available from Polyvinyl Chemie Holland B.V., "PRIMAL" TR934 available from Rohm and Haas (UK) Ltd. and "TEXICRYL" 13-210 available from Scott Bader Ltd. of England. These are all available as aqueous emulsions which generally have a solids content of about 45% by weight and are generally anionic or non-ionic and acidic in character.

Any softening agent for the fibres of the fabric may be used and examples are ethylene polymers and, preferably, epoxidised vegetable oils, both of these generally being provided as aqueous emulsions which include non-ionic emulsifiers for stabilising the emulsion. The softening agent softens, lubricates and improves the tensile and tear strength of the fabric. Particular examples are "BRADSYN" U and BMC available from Hickson and Welch Ltd. of Castleford, Yorkshire, England.

The self-curing elastomeric polysiloxane composition which is employed as an alternative or in addition to the softening agent may comprise, for example, a cross-linkable polysiloxane e.g. a hydroxyl terminated dimethylsiloxane polymer having elastomeric properties, a cross-linking agent therefor, e.g. a methylsiloxane polymer with active H atoms, and a catalyst for the cross-linking reaction, e.g. a zinc salt. One example of such a composition is an aqueous mixture containing "DICRYLAN" WK and "PHOBOTONE" WS both available from Ciba-Geigy (UK) Ltd. of Clayton, Manchester, England, and a suitable catalyst, e.g. zinc chloride or zinc nitrate.

A preferred but optional further component of the composition is a curable amine-formaldehyde prepolymer containing free hydroxyl groups. This component is believed to assist in the cross-linking of the acrylic resin but in any event its incorporation provides a further improvement in wash fastness of the printed fabric. Examples are the polyhydroxy prepolymers from the condensation of formaldehyde with urea, melamine or derivatives thereof, e.g. N,N'-ethylene urea and methylated derivatives of urea and melamine. These curable amine-formaldehyde prepolymers can generally be made available as aqueous syrups and can be incorporated as such in the compositions of the invention.

Proposals have been published for employing such prepolymers as the sole pre-treatment agents for improving the wash fastness of transfer printed cotton fabrics. In the present invention, however, these materials are not employed for this purpose but for the purpose of enhancing the effect obtained by the conjoint use of the acrylic resin and softener and/or polysiloxane elastomer. It is believed that the observed improvement in wash-fastness when the prepolymer is included results from the prepolymer becoming involved in the cross-linking of the acrylic resin. When used, the prepolymers are incorporated in the compositions of this invention in minor amounts relative to the amount of acrylic resin.

When these prepolymers are employed in the compositions of the invention, it is desirable to also include a curing catalyst for them. The cure is generally acid catalysed but the catalyst should be selected to avoid any harsh reaction on the fabric. Examples of suitable catalysts are ammonium chloride, diammonium hydrogen phosphate, zinc chloride and zinc nitrate.

Thus, where the composition includes a self-curing polysiloxane elastomer, the same catalyst may be used for both the elastomer and the prepolymer by choosing a suitable zinc salt.

A disadvantage of incorporating the aforementioned prepolymer is a tendency for the tear strength and tensile strength of the fabric to be reduced. However, this can be maintained within tolerable limits provided the prepolymer is employed in a minor amount as compared with the acrylic resin, e.g. up to 50% by weight of the acrylic reins, and is further alleviated by the presence of the softening agent or polysiloxane or both.

A further improvement can be obtained by including at least one humectant in the composition which will compensate for the tendency of the resin components to dry the fabric and reduce its tensile and tear strength, by assisting retention of moisture in the fabric or causing the fabric to take up a greater percentage of moisture content from the air. Examples of suitable humectants are liquid glycols, such as alkylene glycols, poly(alkylene oxide) glycols and poly(hydroxyalkyl) cycloalkanes, and liquid hydroxylated aliphatic amides. Specific examples are ethylene glycol, cyclohexane dimethanol, polypropylene glycols, and NOPCO GS-15, which is a liquid hydroxylated aliphatic amide soluble in water and alcohol in all proportions and available from Nopco Chemical Company of Newark, New Jersey, U.S.A.

The liquid hydroxylated aliphatic amides are preferred because they also have lubricating and plasticising properties and appear to improve colour take-up or colour yield of the ink. The glycols are also alternatives to the amine-formaldehyde prepolymers for improving the wash fastness and colour yield by apparent involvement in the cross-linking of the acrylic resin, but are generally less effective. Mixtures of glycol and hydroxylated amine humectants may be used.

A further component which may advantageously be included in the composition of the invention is a polymer emulsion used in small quantity and selected to impart a fine-grain surface to the fabric so as to improve ink reception and improve and sharpen the line and tone of the printed design. One preferred polymer emulsion for this purpose is a vinyl copolymer emulsion commercially available from Warwick Chemicals Ltd. of Leeds, England under their reference EP-348.

The composition may also advantageously include a wetting agent to facilitate application of the composition to the fabric. The wetting agent may be non-ionic, cationic or anionic provided it is compatible with the composition; i.e. is not of opposite charge so as to cause precipitation, and may be, for example, a polyalkoxylated long chain alkyl phenol or a sodium salt of a sulfated ester. Suitable wetting agents include surfactants made available commercially by Nopco Chemical Company under their trade marks HYONIC PE-90, DIOTTAU 14, and NOPCO 1186*a*.

The compositions of the present invention are suitably formulated by adding the various ingredients, generally in the form of suspensions or solutions in water, to a predetermined quantity of water and the concentrations given below are in terms of the amount by weight of each component added to a liter volume of water, whether the component is added as such or as a solution or dispersion e.g. in water.

The amount of acrylic resin that is required will depend upon the proportion of fibres in the fabric that do not readily retain dyes imparted thereto by transfer printing and on the kind of fabric, in particular its weight and liquid retention characteristics; heavy fabrics, large proportions of such fibres in the fabric and low liquid retention characteristics requiring larger concentrations of acrylic resin in the liquid composition. In general, the amount of acrylic resin required per liter of water will range for example from about 40g for 50/50 polyester/cotton blends to about 120g for interlock cotton fabrics, the resin being generally added to the water in the form of an aqueous emulsion containing about 40–60% solids. Smaller amounts, although usable, tend to give inadequate wash fastness whereas larger amounts tend to adversely affect the other properties of the fabric, e.g. tensile and tear strength, to an unacceptable extent. The amount of acrylic resin may be reduced proportionately where amine-formaldehyde prepolymer is included. The preferred range is 55g–105g.

The amount of softener used will generally depend on the total of resinous materials (acrylic, polysiloxane and amine-formaldehyde prepolymer) employed in the composition and can vary between wide limits, e.g. 8 to 40 grams, added to a liter of water, the softener generally being added as an aqueous emulsion suitably containing, for example, 30–50% of the softener, by weight.

The self-curing elastomeric polysiloxane composition is suitably also added as an aqueous emulsion and in an amount that provides from 1 to 35 preferably 4 to 25 grams of cross-linkable polymer to each liter of water. The cross-linking agent and the catalyst are preferably each present in an amount of 8 to 25%, generally about 15% by weight, of the cross-linkable polymer.

The amine formaldehyde prepolymer is suitably added as an aqueous syrup having, in general, about 45% to 95% solids content and is preferably added to provide not more than about 50%, and preferably about 5 to 30%, of the prepolymer by weight, based on the weight of the acrylic resin. In general, up to 55 grams and preferably from 20 to 40 grams, of prepolymer solids are added to each liter of water. The catalyst for curing the prepolymer is generally employed in an amount of 2 to 5 grams added to each liter of water or about 1–6% of the total solids content of the composition.

The amount of humectant used depends upon its nature. For example, hydroxylated aliphatic amides are preferably employed in amounts of 5 to 50 grams added to each liter of water. Glycols, on the other hand, are suitably employed in amounts of 5 to 100 grams to each liter of water, depending on their nature. For example poly (alkylene) glycols are preferably employed in amounts of 5–30 grams/liter whereas cyclohexane dimethanol may be used in amounts up to 100 grams/-liter.

The polymer emulsion, when used, is preferably present in an amount of from 2 to 30 grams of solids per liter of water and the wetting agent is preferably added in amounts of from 2 to 30 grams per liter of water.

It will be appreciated that the various components of the composition, when supplied in the form of emulsions or dispersions, must be compatible; that is, they must not be so chosen that they cause precipitation on mixing. In general, therefore, the conjoint use of cationic and anionic dispersions or emulsions should be avoided although non-ionic emulsions or dispersions can often be used with either.

The composition of the invention is applied to the fabric prior to transfer-printing the fabric. The composition may be applied in any suitable manner, e.g. padding, dipping, or spraying. Preferably, however, the fabric is impregnated with the composition by immersing it in the composition and the composition is thereafter squeezed, e.g. as between rollers, to leave the desired amount of composition retained in the fabric.

The amount of wet composition to be retained on the fabric (the wet pick-up of the fabric) will depend upon the solids content thereof, the nature of the fabric and the proportion of fibres in the fabric that do not readily retain dyes applied thereto by transfer printing. The heavier fabrics and the fabrics containing the higher proportions of such fibres require the greater amounts of retained solids. The methods of achieving required wet pick-ups are well known. If on a given apparatus and under given conditions it is not possible or convenient to achieve the desired level of wet pick-up to leave the required level of solids in a given fabric, the solids content of the composition should be adjusted until the available rate of wet pick-up provides the required take-up of the solids. The wet pick-up of the fabric will generally be in the range 40 to 125% by weight of the fabric.

After treatment with the composition, the fabric is then dried and thereafter transfer printed.

To obtain the improvement in wash fastness of the colour printed on the fabric by the transfer printing step, the resin content of the composition taken up by the fabric must be cured. Curing may be effected in any suitable manner but generally by heating. Although improvements in wash fastness can be obtained by effecting cure simultaneously with or after transfer printing, we have found that in general the best improvement in wash fastness is obtained by effecting the cure at least partly, and preferably substantially completely, i.e. to about 85 or 90% of theoretical maximum possible cure, prior to transfer printing. This also reduces the likelihood of gas generation from the coating and in particular from the amine resin when present, during transfer printing. Curing is suitably effected by heating the impregnated fabric at a suitable temperature, usually between 165°–170° C., for a period of from 30 seconds to 1 minute, e.g. depending upon whether a catalyst is employed and the nature of the catalyst.

Transfer printing the treated fabric may be carried out in conventional manner. In general, a temperature of 180° to 215° C. will be employed, depending on the nature of the ink material used, with the application of slight pressure and for a period of, for example, 15 to 60 seconds, the lower temperatures generally requiring the higher residence times. It is not essential that the transfer printing follow immediately on curing. Satisfactory results can be obtained after delays of as much as a year or even more between curing and transfer printing.

Although in general the compositions of the invention are suitable for the pretreatment of fabrics to be printed with any of the dyes employed for transfer printing, which dyes are generally disperse dyes, the improvement in wash fastness that is obtained depends to some extent on the nature of the dye. Particularly good results are achieved with the following which are therefore preferred:

| | | |
|---|---|---|
| B.A.S.F. | YELLOW | RL |
| B.A.S.F. | BLUE | TX 4309 |
| KODAK | RED | 901 |
| KODAK | YELLOW | 809 |
| ICI DISPERSAL | BLUE | B2GTP |

All these dyes are suitable for flexographic, silk screen, lithographic and gravure printing to produce the transfers.

Most colours can be obtained by use of mixtures of the above in known manner.

Any fabric containing fibres which do not readily retain dyes imparted thereto by transfer printing may be treated with advantage with the compositions of the invention. Examples of such fibres are specifically wool and cellulose (natural or regenerated) and specific examples are 100% cotton, polyester/cotton blends, polyester/viscose blends, polyester/"Vincel" blends and polyester/"Viloft" blends. The fabric may be woven, non-woven e.g. as in felt, or knitted. The fabric may be in the natural state, bleached or dyed a light shade or white. The invention is particularly applicable to the treatment of fabrics containing natural or regenerated cellulose fibres, especially cotton.

In one preferred process, a composition in accordance with the invention is placed in a conventional padding machine and the pad rollers are set to the desired expression or wet pick-up of the composition according to the nature of the fabric. The fabric to be treated is passed through the pad machine rollers and then hooked up to a stenter in well known manner. The fabric is then passed through a heating zone such as an oven wherein it is dried and the coating cured, suitably at a temperature of about 165° C. and for a time such as to achieve substantially complete cure, e.g. as indicated by a conventional level-of-cure indicator. The material is than transfer printed and the transfer printing may be effected on flat bed, vacuum flat bed or rotary heat transfer machinery.

The following are specific Examples of compositions according to the invention. In these Examples all percentages are by weight. The amount given for each component is the amount to be added to 1 liter of water.

EXAMPLE 1

For knitted interlock 100% cotton.

| | |
|---|---|
| Vinacryl 43080 (an aqueous emulsion of a self-crosslinking acrylic resin and available from Vinyl Products of Carshalton, England; 45% solids) | 200g |
| Softener: Bradsyn BMC (an aqueous emulsion available from Hickson and Welch, Castleford, England and containing about 40% by weight of epoxidised soybean oil and about 8% by weight of a non-ionic emulsifying agent) | 80g |

The padding machine is adjusted to provide for 100–120% take up of the liquor on the fabric and cure is substantially complete at 165°–170° C. for ½–1 minute. Transfer printing is suitably effected at about 200° C. for 15–25 seconds. The product has commercially acceptable wash fastness in domestic washing machines at 35° to 40° C. with any of the preferred dyestuffs referred to above. If the fabric is transfer printed without pretreatment with this composition, the dyestuff will wash out after a few washes.

EXAMPLE 2

For 100% cotton materials.

| | |
|---|---|
| Vinacryl 43080 | 200–220g |
| Bradsyn BMC | 80g |
| Nopco GS 15 (an aqueous liquid available from Nopco Chemicals Ltd of Newark, New Jersey, USA and containing about 97.5% by weight of hydroxylated aliphatic amide) | 20–25g |
| EP348 (a polymer emulsion available from Warwick Chemicals Ltd of Leeds, England and containing about 50% by weight of solids) | 20–25g |
| Diammonium hydrogen phosphate (catalyst) | 2.3g |

Employing a 100% cotton interlock fabric having a dry weight of 149g/sq. yd, and with the padding machine set to give a wet weight of 382g/sq. yd, after the material has been dried and cured the weight of dry composition left on the material is approximately 22g/sq. yd. Employing any of the preferred dyestuffs, the wash standard of the dyed fabric is similar to that of Example 1.

EXAMPLE 3

For polyester/cotton blends and lightweight 100% cotton fabrics.

| | |
|---|---|
| Vinacryl 43080 | 120g |
| Bradsyn BMC | 48g |
| Nopco GS 15 | 13–15g |
| EP348 | 13–15g |
| Diammonium hydrogen phosphate | 1.4g |

Using a knitted 34/66 polyester/cotton blend having a dry weight of 127g/sq. m and wet padded weight of 202g/sq. m, after drying and curing the weight of the fabric is 134g/sq. m (i.e. dry pick-up is 7g/sq. m). The product after transfer printing with any of the preferred dyestuffs has a commercially acceptable wash fastness in domestic washing machines at 40° to 50° C.

Further improvement can be obtained by replacing 13–15g of the Vinacryl 43080 with an equal amount of a urea-formaldehyde prepolymer syrup (95% solids).

EXAMPLE 4

For 100% cellulosics.

| | |
|---|---|
| "Neocryl" Acrylic Q 717 (an aqueous emulsion available from Polyvinyl Chemie Holland B.V., Netherlands and containing about 45% solids) | 195g |
| B.I.P. urea-formaldehyde prepolymer syrup (available from British Industrial Plastics of 95% solids) | 20–25g |
| Bradsyn BMC | 75–80g |
| Hopco GS 15 | 20–25g |
| EP348 | 20–25g |
| Diammonium hydrogen phosphate catalyst | 2–3g |

Using any of the preferred dyestuffs, the wash standard of the treated and dyed material is about the same as Example 1.

EXAMPLE 5

For 100% cellulosic fibres.

| | |
|---|---|
| Vinacryl 43080 or Rohm & Haas Primal TR934 | 212g |

-continued

| | |
|---|---|
| Bradsyn BMC | 78g |
| Nopco GS 15 | 25g |
| Polypropylene glycol 400 (available from Shell Chemicals, a glycol having the general formula $HO(C_3H_6O)H$ and an average molecular weight of 400) | 15g |
| EP348 | 20g |
| Diammonium hydrogen phosphate catalyst | 2.4g |

The wash standard of the treated and dyed material using any of the preferred dyestuffs is about 40° C. on a domestic washing machine.

EXAMPLE 6

For 100% cellulosic fibres.

| | |
|---|---|
| Scott Bader Texicryl 13–210 (aqueous emulsion of acrylic resin containing 45% solids) | 212g |
| BIP Melamine Formaldehyde Resin 5155 (95% solids syrup) | 38g |
| Bradsyn BMC | 78g |
| Nopco GS 15 | 27g |
| EP348 | 20g |
| Diammonium hydrogen phosphate catalyst | 2.4g |

The wash standard of the treated and dyed material using any of the preferred dyestuffs is about 40°–50° C. on a domestic washing machine.

EXAMPLE 7

For polyester/cellulosic fibre blends, e.g. polyester/-cotton 67/33%.

| | |
|---|---|
| Acrylic resin emulsion (45% solids) | 192g |
| Melamine formaldehyde prepolymer syrup | 34g |
| Bradsyn BMC | 78g |
| Nopco GS 15 | 26g |
| EP348 | 20g |
| Diammonium hydrogen phosphate catalyst | 2.4g |

The wash standard of the treated and dyed material using any of the preferred dyestuffs is about 40°–50° C. on a domestic washing machine and can satisfy ISO 2 on polyester/cotton blends with some dyestuffs.

This formula is also suitable for lightweight 100% cellulosic materials.

The compositions illustrated in the following Examples 8-10 are particularly suitable for difficult fibres such as "Viloft" and viscose fibres. The specific compositions given are designed to be suitable for 100% interlock cotton and 120% wet pick-up (based on dry cloth weight) and it will be understood that the overall solids contents in the bath may require adjustment in accordance with the limitations of the padding machine in relation to pick-up or expression and for application to other fabrics in accordance with desired pick up.

EXAMPLE 8

| | |
|---|---|
| Vinacryl 43080 | 225g |
| BIP Melamine formaldehyde resin 5155 | 40g |
| Nopco GS 15 | 28g |
| Bradsyn BMC | 60g |
| EP348 | 20g |
| Dicrylan W.K. (aqueous emulsion of a cross-linkable elastomeric polysiloxane available from Ciba-Geigy (UK) Ltd. and having a solids content of 27%) | 24g |
| "Phobotone" WS (an aqueous emulsion of a cross-linking agent for the Dicrylan, also available from Ciba-Geigy (UK) Ltd. and having a solids content of about 34%) | 5g |
| Zinc Nitrate catalyst | 4g |

EXAMPLE 9

| | |
|---|---|
| Rohm & Haas Primal TR934 | 230g |
| BIP Melamine Resin 5155 | 40g |
| Dicrylan W.K. | 70g |
| Phobotone WS | 10g |
| Zinc Nitrate | 3.5g |
| EP348 | 20g |

EXAMPLE 10

| | |
|---|---|
| Vinacryl 43080 | 225g |
| BIP Melamine 5155 | 40g |
| Dicrylan W.K. | 54g |
| Phobotone WS | 8g |
| Zinc Nitrate | 3.5g |
| Bradsyn BMC | 26g |
| EP348 | 20g |

In all of the above Examples 8-10, the wash standard achieved on 100% cellulosic fabrics will vary from 40°-50° C. on domestic washing machines to ISO 2 depending on the choice of dyestuffs. On polyester/cotton, polyester/"Viloft" and polyester/viscose blends, the standard will vary from 50° C. domestic machine wash to ISO 2 or ISO 3 depending on the choice of dyestuffs.

EXAMPLE 11

With 100% cotton voile having a dry weight of 52.5/sq. yd. and employing a wet padded weight of 94.4g/sq. yd. and the composition of Example 10, the dry composition pick up will be about 3g/sq. yd. The wash standard will be about 40° C. on domestic washing machines with any of the preferred dyestuffs.

EXAMPLE 12

For poly/cotton, poly/"Viloft" and poly/viscose blends.

| | |
|---|---|
| Rohm & Haas Primal TR934 | 150g |
| BIP Melamine 5155 | 25g |
| Dicrylan W.K. | 35g |
| Phobotone WS | 5g |
| Zinc Nitrate | 3g |

The wash standard employing a wet pick up of about 70% based on the weight of dry fabric and with any of the preferred dyestuffs is of the order of ISO 2 or ISO 3.

It may be desirable to add a dispersion stabiliser e.g. an alkyl phenol polyglycol ether such as "Neckanil" which is available from BASF, Germany, to the above compositions, generally in an amount of from 1 to 3% by weight of the total composition, in order to improve stability of the composition and reduce precipitation of the solids from the composition on to the padding rollers. Larger amounts may be used if desired.

I claim:

1. A method of transfer printing a fabric containing fibres that do not readily retain dyes applied thereto by transfer printing, said method comprising (I) applying to the fabric an aqueous composition formed by the addition to water of (a) a coating material comprising a self-curing acrylic resin composition in an amount to provide 40 to 120 grams of said acrylic resin per liter of said water and excluding any water included in said acrylic resin composition, and (b) at least one of (i) a softening agent for the fibres of the fabric in an amount to provide 8 to 40 grams of said agent per liter of said water and excluding any water added with said softening agent and (ii) a self-curing elastomeric polysiloxane composition in an amount to provide 1 to 35 grams of said polysiloxane composition per liter of said water and excluding any water in said polysiloxane composition.

(II) drying the thus treated fabric.

(III) transfer printing the fabric thus obtained, (IV) curing the resin content of the coating before, during and/or after the transfer printing step.

2. A method as claimed in claim 1 in which the softening agent is selected from the group consisting of ethylene polymers and epoxidised vegetable oils.

3. A method as claimed in claim 1 in which the softening agent is epoxidised soybean oil.

4. A method as claimed in claim 1 in which said aqueous composition further includes an aqueous emulsion of a vinyl polymer in an amount to give from 2 to 30 grams of the polymer per liter of said water and excluding the water of the emulsion.

5. A method as claimed in claim 1 in which said aqueous composition further includes a wetting agent provided in an amount of from 2 to 30 grams per liter of said water and excluding any water supplied with the wetting agent.

6. A method as claimed in claim 1 in which said aqueous composition further includes a dispersion stabiliser provided in an amount of from 1 to 3% by weight of said aqueous composition.

7. A method as claimed in claim 1 in which the fabric contains cotton.

8. A method as claimed in claim 1 in which the resin content of the coating is at least partially cured prior to transfer printing.

9. A method as claimed in claim 1 in which the resin content of the coating is substantially completely cured prior to transfer printing.

10. A method as claimed in claim 1 in which curing is effected by heating the coated fabric at a temperature of from 165° C. to 170° C. for a period of 30 seconds to 1 minute.

11. A method as claimed in claim 1 in which the aqueous composition further includes a curable amine-formaldehyde prepolymer containing free hydroxyl groups, in a minor amount compared with that of the acrylic resin.

12. A method as claimed in claim 11 in which the aqueous composition includes both a softening agent for the fibers of the fabric and a self-curing polysiloxane composition.

13. A method as claimed in claim 11 in which the prepolymer is provided in an amount of from 20 to 40 grams per liter of said water and excluding any water with said prepolymer.

14. A method as claimed in claim 13 in which the prepolymer comprises a condensate of formaldehyde with an amine selected from the group consisting of urea, melamine and substituted derivatives of urea and melamine.

15. A method as claimed in claim 11 in which the aqueous composition further comprises at least one humectant in an amount to provide from 5 to 100 grams of humectant per liter of said water.

16. A method as claimed in claim 15 in which a glycol selected from the group consisting of alkalene glycols, poly(alkylene oxide) glycols and poly(hydroxyalkyl) cycloalkanes is provided as a humectant.

17. A method as claimed in claim 15 in which a hydroxylated aliphatic amide is provided as a humectant in an amount of from 5 to 50 grams per liter of said water and excluding any water added with said humectant.

18. A method as claimed in claim 15 in which said softening agent is selected from ethylene polymers and epoxidised vegetable oils, the composition further contains a prepolymer comprising a condensate of formaldehyde with an amine selected from urea, the group consisting of melamine and substitued derivatives of urea and melamine, and at least one humectant selected from alkylene glycols, poly (alkylene oxide) glycols, poly (hydroxyalkyl) cycloalkanes and hydroxylated aliphatic amides, and the components of the composition are provided in the following amounts per liter of water (excluding any water added with any of the components):

acrylic resin 40–120g
softener 8–40g
self-curing elastomeric polysiloxane composition 1–35g
amine-formaldehyde prepolymer 20–40g
at least one humectant 5–100g

* * * * *